United States Patent [19]

Seefluth

[11] 3,930,332

[45] Jan. 6, 1976

[54] AIRFOIL ROTOR FOR A TOY HELICOPTER

[75] Inventor: Uwe C. Seefluth, Klingberg, Germany

[73] Assignee: Markes & Co. KG., Germany

[22] Filed: Feb. 19, 1974

[21] Appl. No.: 439,083

[30] Foreign Application Priority Data

Feb. 2, 1973 Germany ..... 2305855

[52] U.S. Cl. ..... 46/75; 244/17.11; 416/214

[51] Int. Cl.[2] ..... A63H 27/12

[58] Field of Search ..... 46/75; 244/8, 17.11; 416/214

[56] References Cited

UNITED STATES PATENTS 3,669,566 6/1972 Bourquardez et al. ..... 416/214

FOREIGN PATENTS OR APPLICATIONS 1,237,709 6/1960 France ..... 416/214

*Primary Examiner*—Louis G. Mancene
*Assistant Examiner*—Robert F. Cutting
*Attorney, Agent, or Firm*—Cushman, Darby & Cushman

[57] ABSTRACT

A toy helicopter rotor comprises a hub with rotor blades radiating therefrom. The hub comprises upper and lower hub parts having formations which releasably lock the parts together upon relative turning therebetween. Each blade has a root which is received in a complementary recess in the lower hub part and is trapped by the upper part, whereby the blades are secured to the hub. Projections on the blade roots retain the blades against radial, lateral and torsional movement and prevent them flying out of the hub in use.

11 Claims, 3 Drawing Figures

AIRFOIL ROTOR FOR A TOY HELICOPTER

Figure 1:
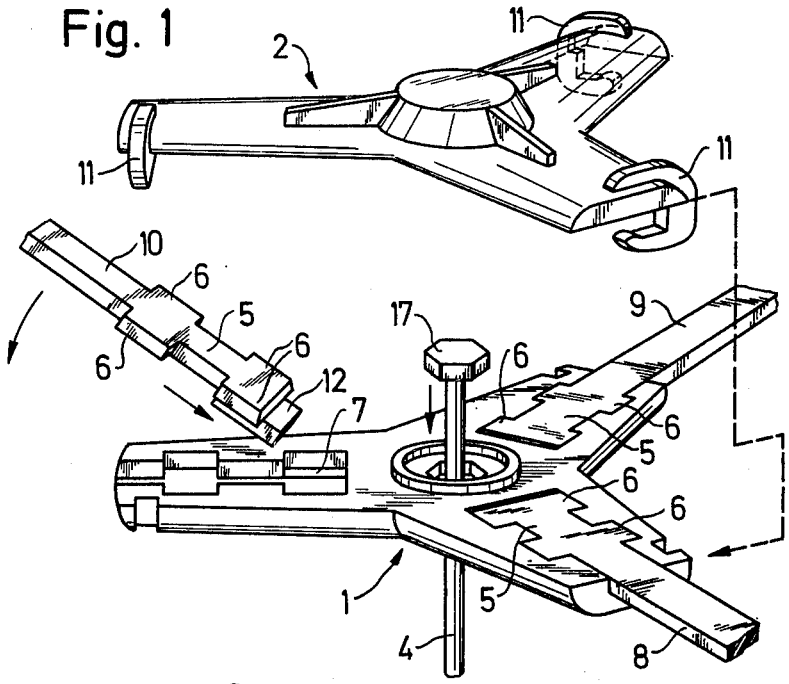

This invention concerns a rotor for a toy helicopter, for example a free flying toy helicopter, which rotor is rotated by centrifugal force for a time during the flight, and which comprises two or more rotor blades releasably fixed to a rotor hub by their blade roots.

In such rotors it is necessary to secure the blade roots such that, as the rotor turns, no aerodynamic variations occur in the rotor blades and so as to ensure that the relatively high radial forces of the rotating blades do not pull the latter out of the rotor hub and thereby cause danger.

It is known to fix the rotor blades of a toy helicopter to the rotor hub in such manner that the centrifugal force radially moves the rotor blades to control their set angle. In this case the rotor blade roots are positioned between two hub bodies and retained by additional connecting means. The disadvantage of this construction resides in that it is relatively difficult to mount or dismantle the rotor blades. In addition, such a construction is technically very expensive and sensitive in operation. Other embodiments provide a rotor which is made in one piece and which must accordingly be fixed to the helicopter as a unit, which produces packing problems owing to the rotor diameter in the case of a large toy helicopter. Moreover, the tool costs for manufacturing a rotor by injection moulding are substantial.

Likewise, in known constructions the rotor blades are made as opposed connected pairs arranged crosswise one above the other and engaged in one another to form a four-blade rotor. In this case the disadvantage is that it is not possible to simply take apart the rotor whithout loosening securing screws or the like if danger due to the rotor blades flying outwards is to be avoided. Moreover, the appearance of such a rotor does not correspond with that of an original helicopter, which has a rotor head in which the individual rotor blades are fixed.

The object of the invention is accordingly to provide a rotor for toy helicopters which does not have the stated disadvantages and which at the same time comes very near to the original appearance of a helicopter.

According to the invention there is provided an airfoil rotor for a toy helicopter, comprising two or more rotor blades which are fixed to a rotor hub by their blade roots, wherein the rotor blades are secured against radial and lateral movement as well as against torsional movement and are positively connected with the rotor hub.

Preferably the arrangement is such that the rotor hub comprises upper and lower body halves which can be positively and releasably connected together by turning with respect to one another about the axis of the rotor shaft, whilst the blade roots of the rotor blades can be positively inserted from the plane between the two hub bodies into at least one body half of the rotor hub. The result of this is that the whole construction of the rotor comprises only the rotor blades and two hub parts. Additional means for connecting the hub parts are not required.

Figure 2:
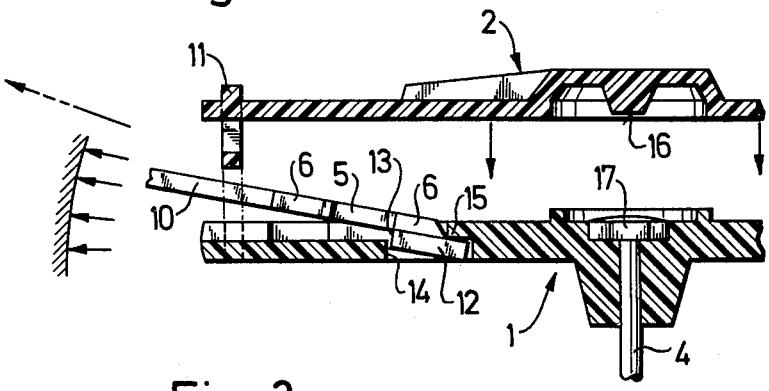
Figure 3:
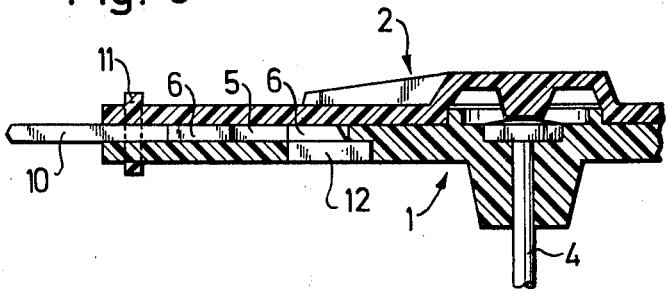

To facilitate understanding of the invention and to enable it to be readily carried into practice, reference will now be made to the accompanying drawings which illustrate one embodiment by way of example. In the drawings:

FIG. 1 is an exploded perspective view of a rotor hub in accordance with the invention, showing one rotor blade root removed, FIG. 2 is a sectional view of a part of the rotor hub according to FIG. 1 with one rotor blade root shown partly inserted, FIG. 3 is a sectional view of the same rotor hub in the closed condition.

Referring to FIG. 1, the rotor comprises a lower hub body 1, an upper hub body 2, a rotor shaft 4 and three rotor blades 8, 9, 10, the roots of which are shown at 5. As can be seen from the drawing, the blade roots 5 have projecting body parts 6 which are so shaped as to permit positive coupling with the lower hub body 1. The lower hub body 1 for its part has a hollow space 7 in which the projecting parts of the blade roots can be inserted. The rotor blades 8 and 9 are shown inserted in the lower hub body 1 in the drawing, whilst the rotor blade 10 is illustrated in a removed condition. The upper hub body 1 can, after it has been laid on the lower hub body 1, be positively connected to the latter to form a unit, by turning the upper body rightwardly through a few millimeters, so that the connecting formations 11 thereon engage the lower hub body. This method of connection also prevents the complete hub sliding on the rotor shaft 4 in the vertical direction as the upper hub body 2 is closed in the region of the axis.

In FIG. 2 the same lower and upper hub bodies 1 and 2, respectively, are shown in partial section. it can here be seen how the blade 10 is anchored by the blade root 5 so that it cannot be pulled out even by high radial forces. This also applies if the rooter blade is lifted through an angle as shown in the drawing.

The blade root has an additional formation 12 which enables the rotor blade to be freed first in the vertical and radial direction if the tip of the rotor blade is lifted further than shown in the drawing so that the whole rotor blade adopts a relatively steep inclined position with respect to the plane of the rotor. The surface 13 on body 12 remains on the opposing surface 14 of the rotor hub when the rotor blade is brought into an inclined position. This ensures that, in the case of unexpected arrest by the upper hub body 2, the rotor blades cannot fly out and thereby cause danger even if the rotor is turning quickly. The step 15 on the blade root 5 enables the rotor blades to be hung in position without falling out in the normal position of the toy helicopter, without affecting the upper hub body 2. As soon as centrifugal forces occur as the rotor turns, the rotor blade 10 will be drawn into the plane in which the rotor turns, whereupon automatic arrest will follow. In this way the inserted rotor blades are secured in several ways.

At the same time it is possible to remove the blades by turning and lifting the hub body 2 so that the rotor can be packed in a small space. The surface 16 of the upper hub body 2 is so shaped as to contact the head 17 of the rotor shaft 4 in the assembled condition of the two hub bodies, and thereby prevent vertical sliding of the lower hub body 1 on the rotor shaft 4.

In FIG. 3 it can be clearly seen that the shaping of the rotor blade root 5 is such as to secure the rotor blade against flying outwards when the rotor is turning at high speed. The connecting formations 11 on the upper hub body 2 engage below the lower hub body 1 and thereby further ensure additional safety in the connection between the rotor blades and the rotor hub.

The described construction can also be modified so that the lower hub body 1 is frictionally or positively fixed to the rotor shaft 4, whilst the upper hub body 2— as already shown — is releasably fixed.

The invention presents various advantages. One is that the rotor blades can be inserted and fixed in simple fashion in the hub of the rotor. Positive connection of the blade roots with at least one part of the hub ensures that unintentional sliding of the rotor blades is avoided and accordingly that detrimental imbalance of the rotor cannot take place. The fixing of the rotor blades to the rotor hub in accordance with the invention ensures that both with the rotor hub open and with it closed, the rotor blades cannot fly out as the centrifugal force which occurs tends to additionally retain the rotor blades. Play appeal of the helicopter is increased by the fact that the rotor blades can be packed in a small space by simply removing the upper half of the hub. A further advantage resides in that the whole rotor comprises merely the blades and the two parts of the hub so that it can be manufactured very economically.

I claim:

1. A rotating wing assembly for free flying toy helicopters comprising:

upper and lower rotor hub members, at least two rotor blades, each of said blades having a rear portion adapted to be releasably insertible into said lower rotor hub member, said rear portion being provided with at least one projection extending laterally therefrom.

said lower rotor hub member being provided with grooves adapted to receive said at least one projection, said upper rotor hub member being provided with connecting members adapted to releasably engage said lower rotor hub member so as to lock said upper and lower rotor hub members together and thereby lock said blades within said wing assembly when said upper rotor hub member is twisted with respect to said lower rotor hub member so as to cause said connecting members to engage said lower rotor hub member.

2. A rotating wing assembly as claimed in claim 1 wherein each of said blades is provided with two pairs of projections, each projection in each said pair being oppositely opposed.

3. A rotating wing assembly as claimed in claim 2 wherein said projections extend substantially perpendicularly to the longitudinal axis of said blade.

4. A rotating wing assembly as claimed in claim 3 wherein the lower rotor hub member has a top and bottom surface and the rear portion of said blade when inserted into said lower rotor hub member is flush with the top surface of said lower rotor hub member.

5. A rotating wing assembly as claimed in claim 1 wherein the rear portion of said blade is provided with an additional projection, said additional projection depending from and extending rearwardly of said rear portion, and wherein said lower rotor hub member is provided with a socket adapted to receive said rearwardly extending projection.

6. A rotating wing assembly as claimed in claim 5 wherein at least a portion of said socket overlies said rearwardly extending projection.

7. A rotating wing assembly as claimed in claim 1 wherein said lower rotor hub member is provided with an opening extending along the vertical axis thereof, said assembly further including a rotor shaft extending through said opening, said rotor shaft being provided with a head and wherein said upper rotor hub member includes a downwardly extending projection adapted to engage the head of said rotor shaft when said upper and lower rotor hub members are locked together.

8. A rotating wing assembly as claimed in claim 1 wherein the portions of said upper and lower rotor hub members which are in contact when said members are locked together are level.

9. A rotating wing assembly as claimed in claim 8 wherein said assembly further includes a rotor shaft located within said lower rotor hub member and wherein said upper rotor hub member is provided with a downwardly extending projection adapted to engage said rotor shaft when said upper and lower rotor hub members are locked together so as to prevent axial shifting of said rotor shaft.

10. Rotor according to claim 7, wherein the lower rotor hub body is fixed frictionally or positively to the rotor shaft, whilst the upper rotor hub body is releasably secured to the lower body.

11. A rotating wing assembly for free flying toy helicopters comprising:

a blade having a shaped rear portion, upper and lower rotor hubs, said lower rotor hub being adapted to receive the shaped rear portion of said blade, said upper rotor hub having connecting members adapted to releasably engage said lower rotor hub when said upper rotor hub is placed in contact with said lower rotor hub and rotated with respect to said lower rotor hub about the axis thereof so as to lock said upper and lower rotor hubs together and said blades within said assembly.

* * * * *